United States Patent [19]

Mauleon et al.

[11] Patent Number: 4,601,814

[45] Date of Patent: Jul. 22, 1986

[54] METHOD AND APPARATUS FOR CRACKING RESIDUAL OILS

[75] Inventors: Jean-Louis Mauleon, Aurora; Robert J. Newman, Englewood, both of Colo.

[73] Assignee: Total Engineering and Research Company, Denver, Colo.

[21] Appl. No.: 498,883

[22] Filed: May 27, 1983

[51] Int. Cl.[4] ..... C10G 11/18; B01J 8/24; B01J 8/22

[52] U.S. Cl. ..... 208/113; 208/153; 502/49; 422/145; 422/214; 422/223

[58] Field of Search ..... 422/145; 208/113, 120, 208/153

[56] References Cited

U.S. PATENT DOCUMENTS

| | | | |
|---|---|---|---|
| 2,398,739 | 4/1946 | Greensfelder et al. | 196/52 |
| 2,414,002 | 1/1947 | Thomas et al. | 196/52 |
| 2,416,730 | 3/1947 | Arveson | 196/52 |
| 2,434,567 | 1/1948 | Jahnig et al. | 196/52 |
| 2,459,474 | 1/1949 | Upham | 196/52 |
| 3,041,273 | 6/1962 | Smith et al. | 208/153 |
| 3,152,065 | 10/1964 | Sharp et al. | 208/157 |
| 3,785,959 | 1/1974 | Bryson et al. | 208/120 |
| 3,835,023 | 9/1974 | Bryson et al. | 208/16 |
| 3,849,291 | 11/1974 | Owen | 208/78 |
| 3,990,992 | 11/1976 | McKinney | 208/120 |
| 4,026,789 | 5/1977 | James | 208/74 |
| 4,176,084 | 11/1979 | Luckenbach | 208/113 |
| 4,200,520 | 4/1980 | Gladrow et al. | 208/120 |
| 4,239,654 | 12/1980 | Gladrow et al. | 208/120 |
| 4,242,237 | 12/1980 | Gladrow et al. | 208/120 |
| 4,289,606 | 9/1981 | Gladrow et al. | 208/120 |
| 4,331,533 | 5/1982 | Dean et al. | 208/113 |
| 4,332,673 | 6/1982 | Myers | 208/120 |
| 4,332,674 | 6/1982 | Dean et al. | 208/120 |
| 4,336,160 | 6/1982 | Dean et al. | 208/113 |
| 4,349,156 | 9/1982 | Haruch et al. | 239/432 |
| 4,354,923 | 10/1982 | Myers et al. | 208/113 |
| 4,405,445 | 9/1983 | Kovach et al. | 208/120 |
| 4,407,714 | 10/1983 | Myers et al. | 208/120 |
| 4,427,537 | 1/1984 | Dean et al. | 208/120 |
| 4,434,049 | 2/1984 | Dean et al. | 208/153 |

FOREIGN PATENT DOCUMENTS

| | | | |
|---|---|---|---|
| 2001545 A | 2/1979 | United Kingdom | 502/43 |

*Primary Examiner*—D. E. Gantz
*Assistant Examiner*—O. Chaudhuri
*Attorney, Agent, or Firm*—Sheridan, Ross & McIntosh

[57] ABSTRACT

A process is described for converting residual oil with fluid catalyst particles which comprises passing an upflowing suspension of fluid catalyst particles at an elevated temperature upwardy through a riser reaction zone/atomizing a residual oil feed to be converted to a particle size commensurate with the particle size of the catalyst particles in the upflowing suspension; discharging the atomized residual oil at a velocity in excess of 300 ft./sec. for contact with said upflowing catalyst particle suspension; maintaining the temperature of contact between said catalyst particles and said atomized residual oil feed suspension sufficiently elevated to obtain up to 50 percent thermal conversion of the atomized oil feed and catalytic conversion thereof by an order of magnitude greater than obtainable with a less atomized oil feed; and separating the suspension vaporous products of the previous step from catalyst particles in a time frame less than two seconds.

14 Claims, 6 Drawing Figures

FIG. III
FIG. I
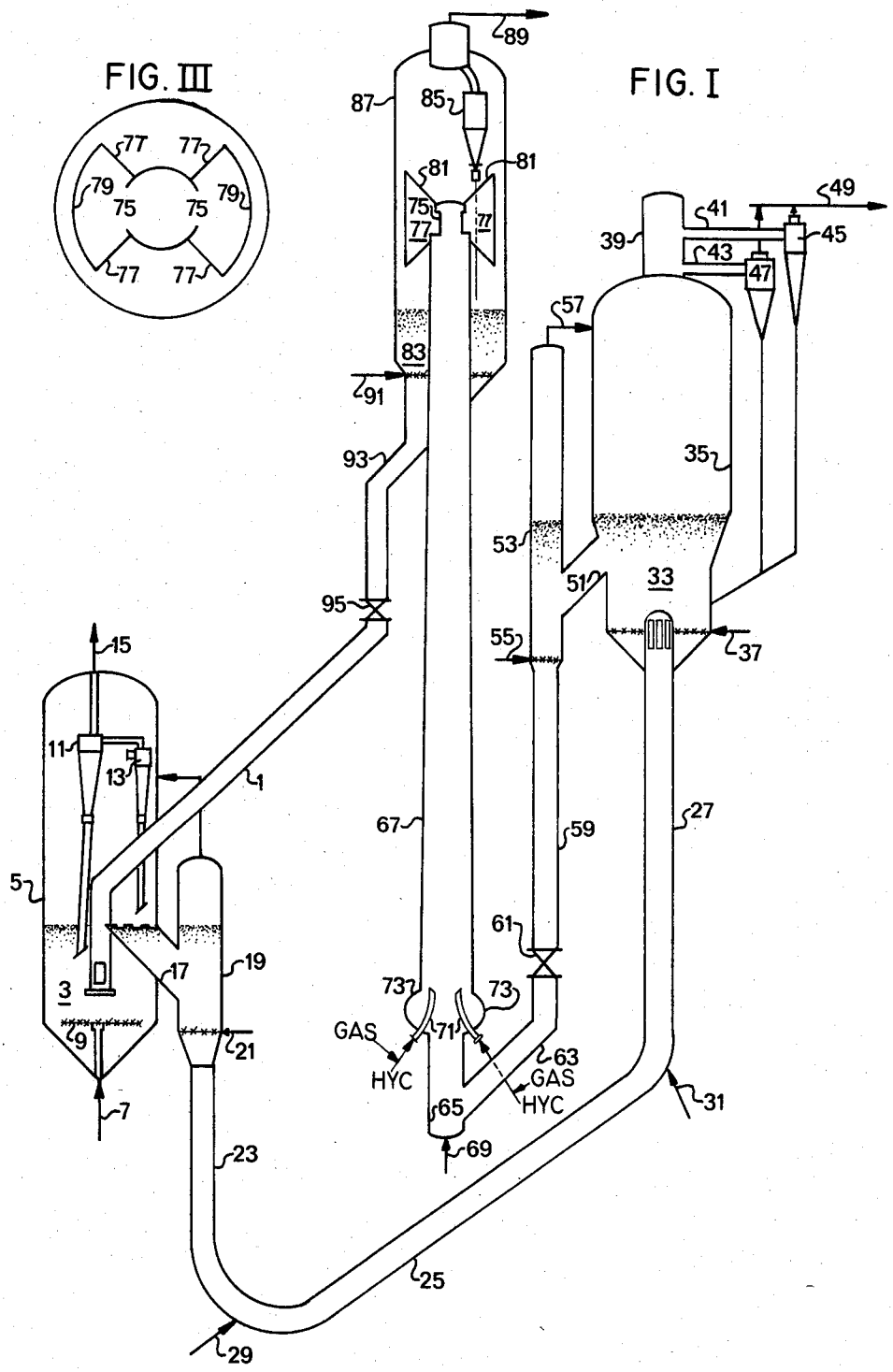

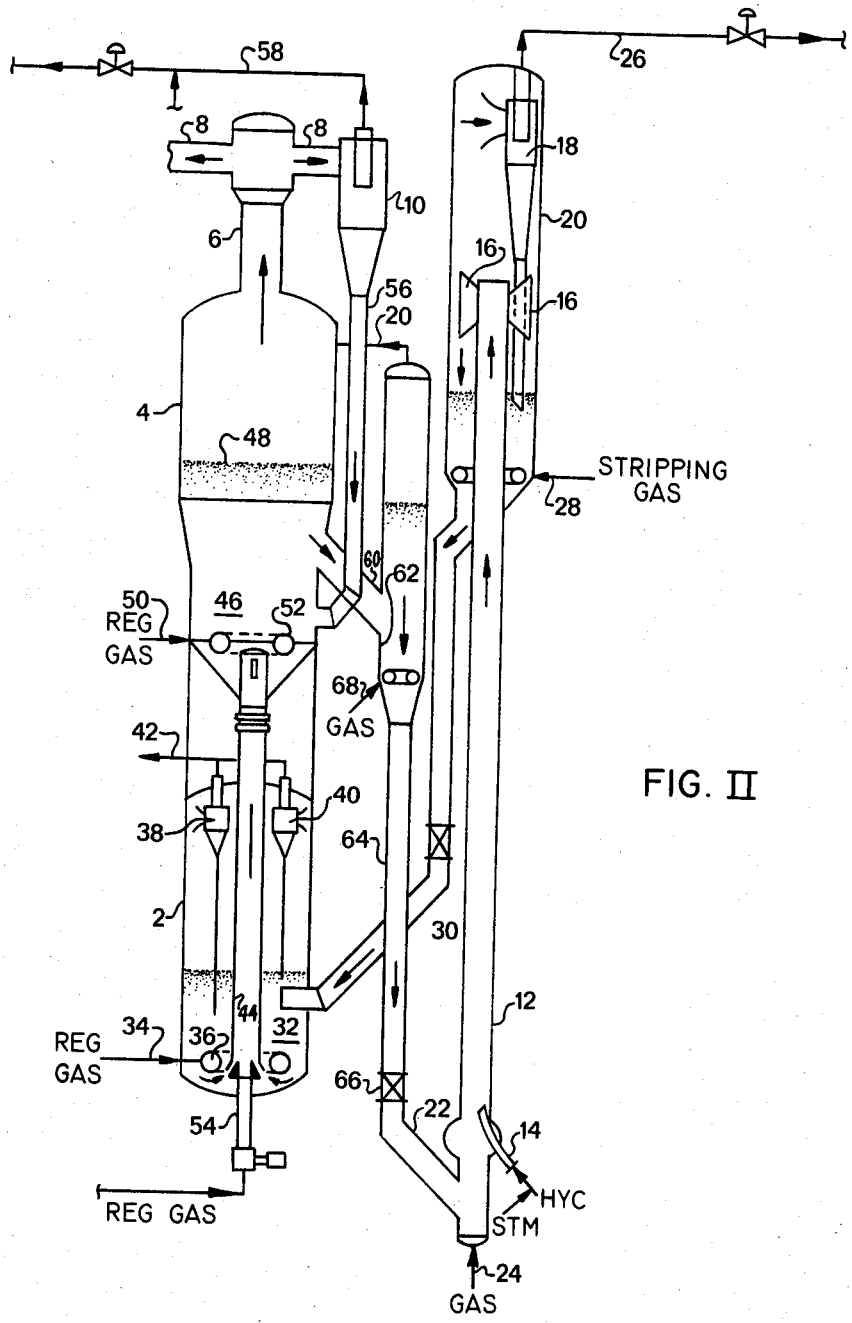
FIG. II

FIG. IV
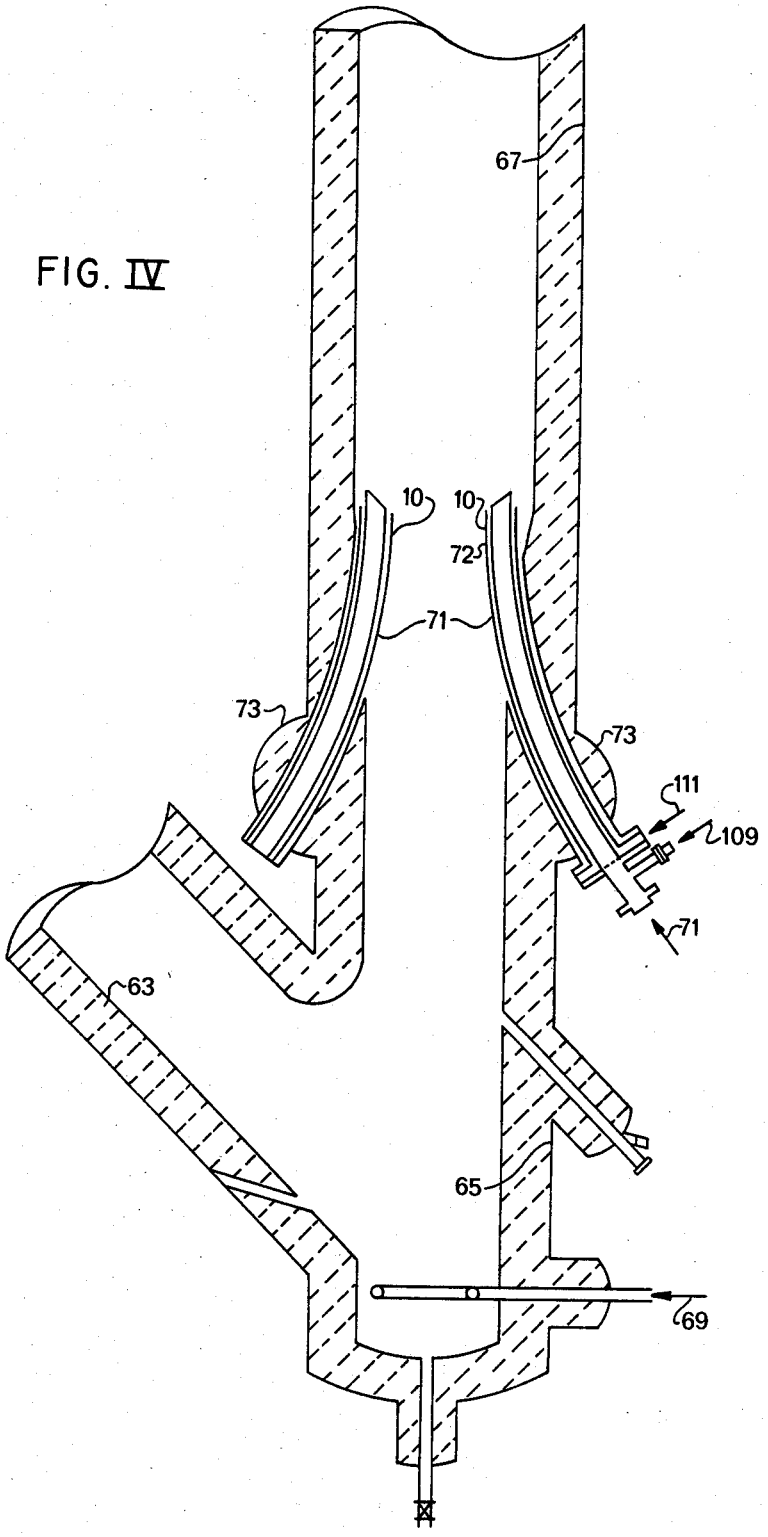

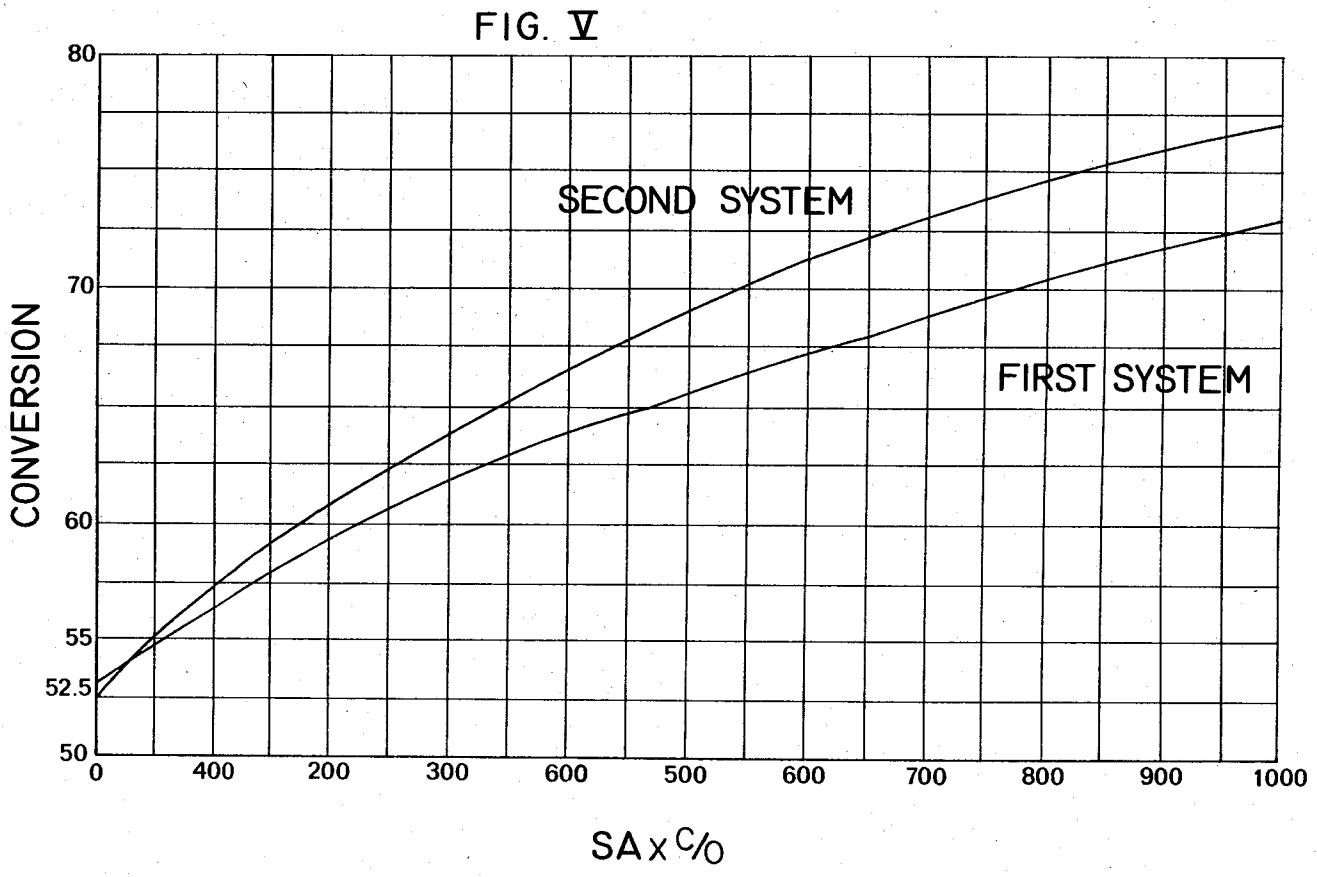
FIG. V
SECOND SYSTEM
FIRST SYSTEM
CONVERSION
80
70
60
55
52.5
50
0
400
200
300
600
500
700
800
900
1000
SA x C/O

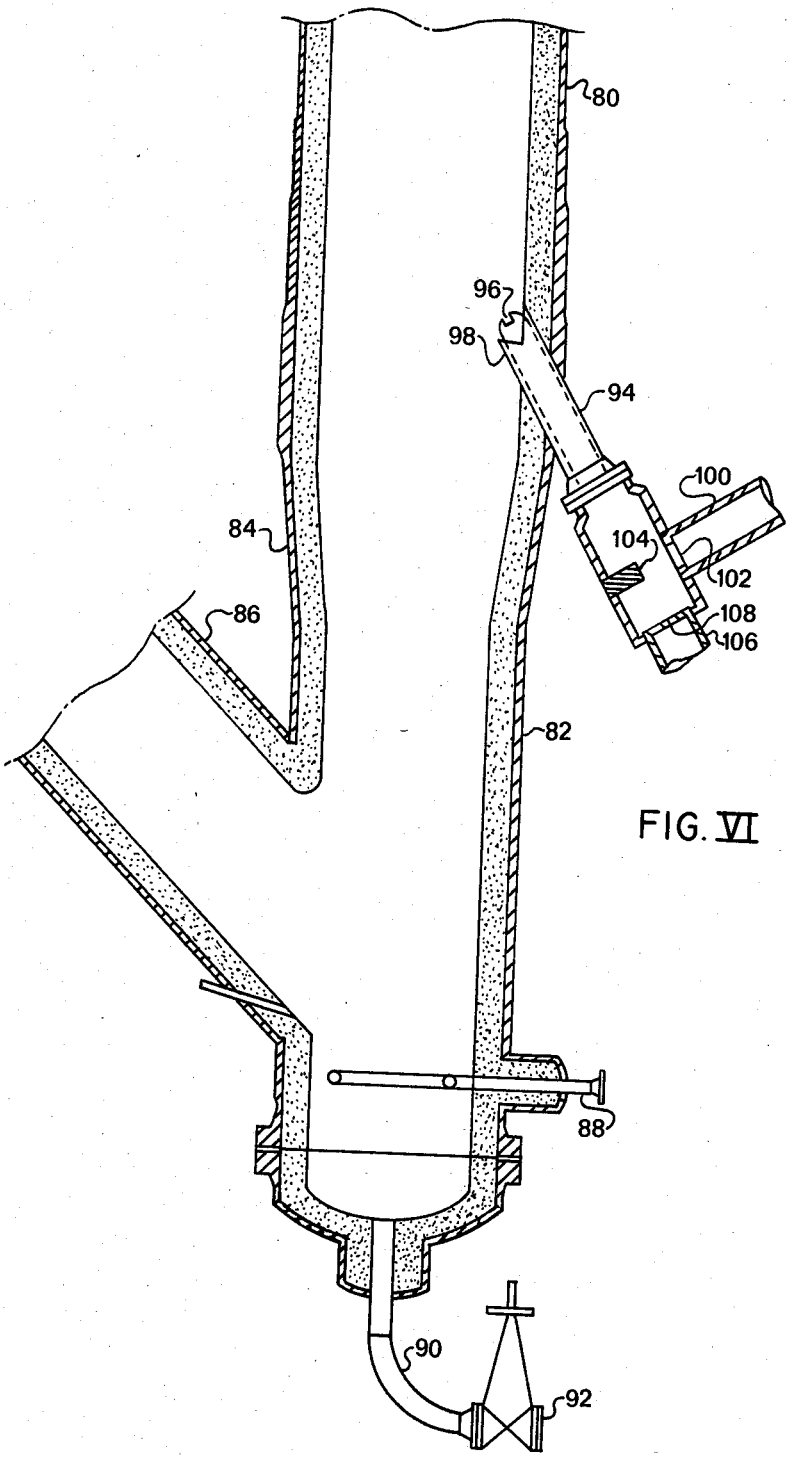
FIG. VI

METHOD AND APPARATUS FOR CRACKING RESIDUAL OILS

The prior art identifies residual oils as residual, reduced crude oils, atmospheric tower bottoms, topped crudes, vaccuum resids, or simply heavy oils. Such high boiling portions of crude oils are also known as comprising very refractory components, such as polycyclic aromatics and asphaltenes, which are considered difficult to catalytically crack to form high yields of gasoline plus lower and higher boiling hydrocarbon fractions because of the deposition of large amounts of coke on the catalyst. Furthermore, metal contaminants in the heavy oil fractions of crude oil comprising vanadium, nickel, copper, iron, etc. are deposited on and/or in the pores of the catalyst, thereby further poisoning and/or inactivating the catalyst so employed. Indeed the prior art considers that the effect of the coking tendencies of the heavy oil fractions plus the heavy metals effect are so overpowering that the resulting product yield structures are unacceptable in terms of industry economics.

In view of prior art identified problems for processing heavy crudes and bottom fractions thereof, comprising such contaminants, it has been previously proposed to effect a separation of materials comprising the residual or heaviest fractions or to effect a preconversion of the heaviest and undesirable components. Different techniques to accomplish the desired separation, such as vacuum distillation, solvent extraction, hydrogenation or certain thermal cracking process, have been relied upon in the prior art for contaminant separation or control. Adsorption of undesired components, particularly metal components, on particulate material of little or no cracking activity has also been employed. Thermal cracking, such as delayed and fluid coking, as well as visbreaking operations, have been employed to upgrade heavy residual oils; however, the resultant products boiling above 400° F. have not proven to be particularly good feed stocks for fluid catalytic cracking due to resultant high concentrations of polynuclear compounds.

Residual oil comprising relatively high boiling fractions of crude oil obtained as atmospheric tower bottoms and/or vacuum tower bottoms contained therein are, therefore, regarded as distress stocks by the petroleum industry because the oils contain large quantities of components generally considered to have coke forming tendencies as well as heavy metal components. For example, a residual oil may contain a carbon residue in excess of 0.6% by weight, and this characteristic is considered by the industry to contribute to producing high additive coke in a cracking operation and along with the high metals levels will operate to rapidly deactivate the cracking catalyst, leading to uneconomic yield results. Hence, the prior art has tended to exclude these materials from fluid cracking feeds.

Residual oils for the purpose of this invention can include materials boiling from 400° F. to the final end point of crude oil, in excess of 1800° F. Contained in this broad boiling range feed stock can be light gas oils boiling from about 400° F. to 700° F., medium gas oils boiling from about 600° F. to 850° F., heavy gas oils boiling from about 600° F. to 1200° F., and components boiling beyond 1200° F. up to the final boiling point of the crude oil, including carbon producing components, such as polycyclic aromatics, asphaltenes and metal contaminants, as well as whole crudes. Separately prepared stocks such as those prepared by solvent extraction of hydrogenated stocks may also be included as feed to the process.

THE INVENTION

This invention relates to the simultaneous conversion of both the high and low boiling components contained in residual oils with high selectivity to gasoline and lighter components and with low coke production. The past problems related to high regenerator and catalyst temperatures are substantially obviated by the processing concepts of the invention. Indeed this invention encourages high catalyst regeneration temperatures and takes advantage of these high temperatures of the catalyst to cause the desired cracking reactions to occur, at high conversion and high selectivity to gasoline and products which are gasoline precursors on a once through basis, without excessive coke formation. Fluid catalytic cracking is successfully practiced with feed stocks derived by distillation, solvent extraction and by hydrogenation, up to distillation ranges capable of instantaneous vaporization by hot regenerated catalyst. Experiments with cracking of the high boiling residual hydrocarbon components have met with less than desired results due to substantial measure to the fact that the prior experimentors were considerably constrained and failed to appreciate that success is only possible if substantially instantaneous and complete atomization/vaporization is achieved by the initial contact of the heavy oil feed with very hot catalyst particles at a temperature above the pseudocritical temperature of the residual oil feed. This means that as the boiling range of a gas oil feed is increased by inclusion of residua, the catalyst temperature must also be increased. The prior art has not only failed to recognize this concept, and thus ignored these facts, but has deliberately restrained the process from achieving the necessary high catalyst temperature due to two factors.

(1) metallurgical limits of the regeneration equipment, and (2) Thermal stability of the catalyst.

Current available fluid cracking art tends to agree that the maximum practical temperature of regeneration and, therefore, the resulting regenerated catalyst temperature should be restricted to within the range of about 1300° F.–1400° F. even though temperatures up to 1500° and 1600° F. are broadly recited. The temperature restriction of 1300° F.–1400° F. in reality necessarily restricts therefore the oil feeds charged to catalytic crackers, to distilled, solvent extracted and hydrogenated gas oil stocks separated from residua boiling above 1025° F. in order to achieve desired conversion levels.

The present invention deals with providing an arrangement of apparatus or equipment and techniques of using, which will permit among other things extending the temperature of catalyst regeneration up to at least 1800° F. without unduly thermally impairing catalyst activity. The invention also identifies an array of equipment or apparatus means capable of withstanding the severe temperature operations contemplated by the invention.

Thus, for example, the undistilled portion of crude oil boiling from about 400° F. or higher, up to the crude oil end point such as provided by topped crude oils can be cracked under conditions achieving high conversions of the oil feed to form lower boiling materials including gasoline and lighter hydrocarbons with gasoline yield results comparable to prior art gas oil cracking including comparable coke makes. The need for expensive feed clean up or preparation techniques and apparatus in the form of distillation, solvent extraction, hydrogenation or various thermal processes is thus obviated.

The products produced from the process of the invention will be similar to those derived from the more conventional relatively clean gas oil fluid catalytic cracking operations. That is, $C_2$'s and lighter gases, $C_3$ and $C_4$ olefins, and paraffins, gasoline boiling from $C_5$'s to 430° F. end point and cracked light and heavy cycle oils are obtained. The cracked cycle oils or gas oils thus obtained and known as light and heavy cycle oils or decanted oil are of such a quality that they can be hydrogenated for sale as low sulphur fuel oils, mildly hydrogenated and returned to the fluid catalytic cracker for more complete conversion to gasoline or preferably some or all may be hydrocracked more completely to produce gasoline boiling components.

Hydrocracking of the cracked cycle oils obtained as herein described to form gasoline coupled with alkylation of the catalytic $C_3$'s and $C_4$'s results in yields of gasoline per barrel of 400° F.+ crude oil residuum charged to the catalytic cracker of up to 125% plus 3–4% propane. Such an overall processing sequence is in energy balance if not a net exporter of fuel gas and steam to other applications. The energy balance includes that required for crude oil topping operation.

A most important parameter for successful residual oil cracking is to be sure that a most complete intimate flash vaporization contact between fluid catalyst particles and heavy oil feed is achieved. That is providing substantially complete atomization/vaporization of particularly the high molecular weight components of the feed substantially upon contact with the hot catalyst particles improves the conversion operation. The residual higher boiling portion of the feed along with the lower boiling gas oil portion is encouraged to be substantially completely vaporized upon contact with the hot regenerated catalyst at a temperature above the feed pseudo-critical temperature because only by more completely achieving the atomized vaporization of the feed components can more of the feed be more completely cracked to gasoline yielding components. What does not vaporize remains essentially unconverted resulting in considerable yields of catalytic cycle oils and/or is adsorbed on the hot catalyst surface and tends to be converted particularly to coke, thereby resulting in a loss of gasoline yield and a rapid lowering of catalyst activity. For achieving optimum desired conversion, the mix temperature between oil feed and catalyst should be at least equal to and preferably above the pseudo-critical temperature of the residual oil feed charged but not so much higher that undesired overcracking occurs.

The feed preheat temperature, the temperature of the hot regenerated catalyst particles, the catalyst cracking activity, the volume of diluent such as steam injected with the feed, the hydrocarbon vapor residence time in contact with catalyst and the unit operating pressure are main operating variables readily available to the petroleum refiner to achieve the reaction conditions necessary to accomplish substantially complete vaporization of the feed and, in turn, achieve a high selectivity conversion to gasoline and lighter hydrocarbons in combination with the production of heavier cycle oils of a quality suitable for hydrogenating or hydrocracking to form additional gasoline boiling range material.

An additional desired operating parameter is that of providing an equilibrium temperature in the riser cross-section, substantially instantaneously with well designed and arranged feed injection nozzles. A feed exit velocity at the outlet in the range of 10 to 1300 feet per second and preferably from 300 to 500 or more feet/second is particularly desired, with the feed nozzle outlet arranged with respect to the riser cross-section to spray at least equal area circles of the riser cross-section. Each feed nozzle may or may not be steam jacketed as desired to reduce any potential coking of the hydrocarbon feed charged through the barrel of the nozzle. A substantial amount of diluent, up to about 7 weight percent of steam or other suitable diluent material is also injected with the residual oil feed to reduce the equilibrium flash temperature thereof and to provide the best achievable oil atomizing effect with a given nozzle design. Typical oil feed dispersion steam or diluent rates range from 1 to 15 weight percent on feed.

The above identified factors relating to the contacting and mixing of the atomized oil feed with fluid catalyst particles are intended to accelerate a mixture thereof relatively uniformly and rapidly through the riser vaporization zone in a minimum time frame and thus provide minimum if any catalyst slippage thereby enhancing rapid heat transfer from the hot catalyst to the heavy atomized oil feed and prevent localized enhanced catalyst to oil ratios representative of dense catalyst phase conditions. That is, conditions are selected to ensure dilute phase contact between catalyst and oil feed in the riser vaporization section and down steam portions thereof as opposed to localized dense phase contact conditions within the riser.

Typically, a reduced crude heavy oil feed contains from 10 to 12% hydrogen in its molecular structure. The lighter fractions are generally richer in hydrogen than the heavier fractions. Generally the heavier and larger molecular structures are considered hydrogen deficient. The lighter, hydrogen rich fractions are relatively thermostable but are relatively easily catalytically cracked with special catalyst compositions such as zeolite containing catalysts. The heavier high molecular weight or hydrogen deficient fractions of the oil feed are viewed as thermounstable and readily thermocracked on contact with solids at temperatures in the range of from 1000°–1800° F. Indeed the instantaneous and complete vaporization of the heavy fractions, discussed above, encourages simultaneous thermocracking of the high molecular weight components including some asphaltenes leading to the ultimate successful conversion of more of the total residual oil feed to high gasoline and cycle oil yields with low coke and gas make. Achieving complete atomization/vaporization of the heavy components of residual oil feed substantially instantaneously upon contact with the fluid catalyst particles through the mechanisms of sufficiently high catalyst temperature, low hydrocarbon partial pressure plus the use of an atomizing oil feed nozzle injection system is relied upon to prevent localized dense phase cracking and thus encourages the desired thermocracking of some of the large asphaltene type structures to form lower boiling cycle oils at the expense of producing coke. Failure to accomplish the above will lead to the phenomenon of "coke shut-off". This is a phenomenon where heavy hydrogen deficient molecules are deposited and block the pores to active cracking sites of the catalyst rendering the catalyst relatively ineffective in terms of a lengthy active life for producing high conversions of the heavy oil feed to desired products from either the light and/or heavy components of the feed.

In the design and operation of a unit of the type contemplated and described by this invention, a basic consideration essential to the operation is that the temperature of the fluid catalyst regeneration operation must be essentially carbon burning unrestrained at least up to achieving a temperature of about 1800° F. While the factors associated with feed preheat temperature, riser temperature, hydrocarbon partial pressure, and the method of feed nozzle injection and distribution are important, they each are restrained by practical limitations and once each is optimized with respect to their practical limitation one must recognize the fact that the temperature of the catalyst regenerator must be unrestrained with respect to carbon burning so that the temperature can be allowed to rise to a level which suit the needs of a particular heavy oil feed stock composition to achieve the herein desired instantaneous atomized-vaporization contact with catalyst particles promoting catalytic cracking and simultaneous thermocracking of the large, less stable molecular structures in the feed.

Table 1 shows the effect on gasoline and coke make when cracking a particular atmospheric resid without a regeneration temperature restraint compared to cracking with the regenerator restrained with respect to temperature. These operations are compared to cracking a gas oil obtained from the same crude oil following vacuum reduction to remove asphaltic type components and cracking the resultant gas oil under prior art conditions.

Table 1 shows that as the regenerator or catalyst temperature is restrained in a resid cracking operation gasoline yield decreases significantly and coke make increases rather correspondingly. It should also be noted that residua can be cracked to higher gasoline yields and at similar coke makes as obtained with a conventional gas oil feed stock.

Table 2 emphasizes the same factors wherein gas oil cracking data is shown compared to 10 volume percent and 20 volume percent vacuum residua added to the same gas oil feed. This tabulation demonstrates that the presence of the residua under optimized conditions results in higher overall conversions, higher gasoline yields and equal if not slightly lower coke makes than conventional gas oil cracking.

TABLE 1

Effect of Restraining Regenerator Temperature and Comparison of Atmospheric Bottoms With Gas Oil Only Feed

| | Atmospheric Bottoms | | Gas Oil Only |
|---|---|---|---|
| Regenerator Temp: | High | Low | Conventional |
| Gasoline Yield Vo. %: | 67.7 | 63.5 | 61.5 |
| Coke Wt. %: | 5.3 | 8.0 | 6.1 |

TABLE 2

Gas Oil Cracking Present Art Versus Resid Cracking

| | Gas Oil | Gas Oil + 10% Resid | Gas Oil + 20% Resid |
|---|---|---|---|
| | Mild Conversion Operation | | |
| Conversion Vol. % | 66.0 | 71.0 | 79.0 |
| Gaso. Yield Vo. % | 59.8 | 61.8 | 66.1 |
| Coke Wt. % | 3.0 | 3.6 | 5.6 |
| | Optimum Conversion Operation | | |
| Conversion Vol. % | 76.5 | 77 | 79.5 |

TABLE 2-continued

Gas Oil Cracking Present Art Versus Resid Cracking

| | Gas Oil | Gas Oil + 10% Resid | Gas Oil + 20% Resid |
|---|---|---|---|
| Gaso. Yield Vol. % | 61.5 | 67.4 | 67.7 |
| Coke Wt. % | 6.1 | 4.3 | 5.3 |

Analyses of the products produced when cracking full atmospheric bottoms compared to gas oils only from the same crude oil show certain other interesting properties;

(1) Liquid products produced have higher average hydrogen contents.

(2) The research octane of the gasolines is significantly higher.

(3) The motor octane of the gasolines is significantly higher resulting in a much improved (R+M)/2 rating important in unleaded gasoline production.

(4) The cracked gas oil products commonly referred to as light and heavy cycle oils and decanted oil are substantially richer in di and tri condensed aromatics in preference to 4, 5 and 6 condensed aromatic rings. The high concentration of two and three member condensed aromatics in the cracked product makes these stocks highly desirable feeds for hydrocracking to gasoline.

(5) The coke produced under optimum operating conditions is very low in hydrogen content. Hydrogen levels in the 3–6 weight percent range are observed versus 8–10 weight percent obtained in prior art gas oil cracking operations. The lower hydrogen level of the coke produced is only explainable by the fact that the operating conditions employed encourages polymerization of polycyclics attracted to the catalyst surface, thereby releasing significant amounts of additional hydrogen for utilization in hydrogen transfer reactions in order to obtain the observed higher hydrogen content of the liquid products. This phenomenon is not observed in the present day gas oil cracking. These reactions are exothermic and hence significantly offset the endothermic heat of reaction of the primary cracking reaction. As a result the overall heat of reaction may be reduced as much as 40 to 50%. This contributes to lower catalyst circulation rates and consequently lower coke makes. The low hydrogen level in the coke is also a major factor of consideration when catalyst regeneration is conducted in the manner embodied in this invention.

A highly siliceous catalyst comprising one of alumina or magnesia with or without a catalytically active crystalline aluminosilicate or crystalline zeolite and of a fluidizable particle size preferably in the range of about 20 to about 200 micron size may vary considerably in cracking activity and levels of metal contaminants accumulated in the cracking operation. If the build up of the metals on the catalyst precludes maintaining a desired conversion level, it is contemplated employing a continuous or semi-continuous catalyst make up and removal or disposal of contaminated catalyst to maintain desired cracking activity aside from regeneration of the catalyst. The catalyst inventory may also be substantially completely or partially replaced as required at turnaround conditions, after an extended period of operation or in response to a change in feed composition as is most convenient to the operation to achieve desired conversion of the feed.

Metals poisoning has long been recognized as a major obstacle to resid cracking. It has been found, however, that these metal contaminants can be passivated to some considerable extent at a high regenerator temperature and their adverse effects markedly reduced when the coke on recycled catalyst is maintained below about 0.05 weight percent. It has been found that about 5% conversion is lost per 0.1 weight percent coke on regenerated catalyst in addition to the expected coke deactivation, because of metals contamination. However, in the reduced crude cracking operation of this invention metals like nickel, vanadium and iron, show some beneficial properties such as activating or enhancing dehydrogenation, hydrogen transfer reaction, and promote CO combustion in the regenerator to achieve a lower coke on recycled catalyst without any need for an outside promoter. On the other hand, sodium and all alkaline metals are still regarded as severe contaminants for particularly a zeolite containing catalyst. Thus, it has been found that feed desalting is a more economical approach to solving the sodium problem than using "soda sink" scavengers. With proper desalting of the feed, sodium therein can be controlled well below 1 PPM.

CATALYST REGENERATION

In order to achieve the desired high catalyst temperatures required to properly effect successful cracking of oils comprising residual oils, special regeneration techniques are required along with specially designed and employed apparatus or operating equipment. The high temperature cracking technique of the invention encourages relative high levels of coke or hydrocarbonaceous material to be deposited on the catalyst during its exposure to the oil feed. Levels not normally below 1 weight percent and in some instances over 2 weight percent will occur. It is particularly desirable, however, to regenerate the catalyst to carbon levels below 0.10 weight percent desirably to at least 0.05 and more preferably to about 0.02 weight percent. Regeneration techniques and apparatus or equipment employed in present day cracking of gas oils are unsuitable for achieving the severity of catalyst regeneration required in residual oil cracking for the following reasons:

(1) The high coke levels permitted to build on the catalyst are encouraged by low catalyst circulation rates, that is, by low catalyst to oil ratios. The combination of low catalyst to oil ratios and high carbon levels leads automatically to high regeneration temperatures. Temperatures that are in excess of the normal limits placed upon the stainless steel employed in present day regenerators, in the design of cyclone systems and catalyst withdrawal systems, etc. Also the temperatures contemplated are beyond the current temperature limits of present day power recovery systems of about 1400° F.

(2) The high activity catalysts presently employed in catalytic cracking are not structurally thermostable at the high regenerator temperatures of the invention if this severe regeneration is conducted in a single stage or even in a multi-stage regenerator where the multi-stages are contained in a single vessel. Two very basic factors effect the catalyst stability during regeneration. At higher and higher coke levels on the spent catalysts, higher and higher catalyst particulate temperatures are developed as the high level of coke is burned in a single vessel even if multi-stage single vessel regeneration is employed. These high surface temperatures themselves will render the catalyst ineffective. Secondly, the catalyst deactivates rapidly at high temperatures when the steam formed during coke combustion from associated molecular hydrogen is allowed to remain in contact with the catalyst when the catalyst reaches its highest temperature.

A particular embodiment of this invention is to conduct the regeneration of the spent catalyst in a two vessel system, comprising of two stage sequential catalyst flow system designed and operated in such a particular manner that the prior art catalyst regeneration difficulties are overcome. The catalyst regeneration arrangement of this invention achieves a coke on recycled catalyst level preferably less than 0.02 weight percent without exceeding undesired metallurgical limitation or catalyst thermostability.

The catalytic cracking process of this invention relates to the cracking of high boiling hydrocarbons generally referred to as residual oils and boiling initially at least 400° F. or higher, obtained from crude oil, shale oil and tar sands to produce gasoline, lower and higher boiling hydrocarbon components. The residual oil feed is mixed in a riser reaction zone with a highly active cracking catalyst recovered from a regeneration zone at a temperature preferably above the feed pseudo-critical temperature. The hydrocarbon feed at a temperature above about 400° F. is mixed with hot regenerated catalyst at a temperature at least equal to the feed pseudo-critical temperature under conditions to form a high atomized and generally vaporous hydrocarbon-catalyst suspension. A suspension separation device or arrangement employed at the riser discharge separates from about 70–90% of the catalyst from the vaporous material. A unique feature of one particular suspension separation device employed is that it allows relatively high vapor superficial velocities during disengagement from catalyst solids in the disengaging vessel before the vapors enter the reactor cyclones for further separation of entrained catalyst solids. Hydrocarbons leaving the reactor cyclones are separated in a downstream fractionation column. The spent catalyst particles recovered from the riser cracking operation are stripped at an elevated temperature in the range of about 900° F. to about 1100° F. comprise deactivating carbonaceous residue in the range of 1.0 weight percent to about 2.5 or more weight percent of coke. The stripped catalyst is passed to a first dense fluid bed of catalyst in a first temperature restricted catalyst regeneration zone maintained below about 1500° F. and more usually not above about 1400° F. The hydrocarbonaceous material combustion to be accomplished in the first temperature restrained stage of catalyst regeneration is one of relatively mild temperature sufficient to burn all the hydrogen present in hydrocarbonaceous deposits and from about 10 to 80% of the total carbon therein. The regenerator temperature is restricted to within the range of 1150° F. to 1500° F. and preferably to a temperature which does not exceed the hydrothermal stability of the catalyst or the metallurgical limits of a conventional low temperature regenerator operation. Flue gases rich in CO are recovered from the first stage regenerator and usually are directed to a CO boiler to generate steam by promoting more complete combustion of available CO therein. They may be passed through a power recovery prime mover section prior to passage to a CO boiler. The mild restrained catalyst regeneration operation serves to limit local catalyst hot spots in the presence of steam formed during the hydrogen combustion so that formed steam will not be at a temperature to hydrothermally substantially reduce the catalyst activity. A partially regenerated catalyst of limited temperature and comprising carbon residue is recovered from the first regenerator substantially free of hydrogen. The hydrogen freed catalyst comprising residual carbon is passed to a second separate unrestrained higher temperature catalyst regeneration operation wherein the remaining carbon is substantially completely burned to $CO_2$ whereby an elevated catalyst temperature within the range of 1400° F. up to about 1800° F. is achieved in a moisture free atmosphere.

The second seprate stage comprising a high temperature catalyst regenerator is designed to limit catalyst inventory and catalyst residence time therein at the high temperature while permitting a carbon burning rate to achieve a residual carbon on recycled hot catalyst particles less than about 0.05 weight percent and more preferably less than about 0.02 weight percent.

Traditionally designed catalyst regenerators utilized in prior art fluid catalytic cracking operations have contained various internal components fundamental to the successful operating needs of the process. These include cyclones, usually of several stages and designed to limit process losses of catalyst, catalyst return conduits (diplegs) from the cyclones to the catalyst bed, various support and bracing devices for the above mentioned means. A hopper or similar device plus associated conduits to enable collection and withdrawal of catalyst and passage back to the cracking step of the process. Of necessity, in prior art systems, these various above-mentioned means are of metallic construction, usually stainless steel, and exposed directly to the combustion temperatures of the regenerator. It is the presence of these metal exposed means in the regeneration combustion zone that limit the maximum temperature that can be attained or supported in the regeneration of catalyst. Generally this leads to a maximum upper operating temperature limit of about 1400° F. or 1500° F.

The second separate stage high temperature catalyst regenerator embodiment of this invention eliminates problems associated with the above mentioned limitations by locating all metal exposed devices such as cyclones, diplegs, draw off hopper or well and support systems outside the combustion zone and indeed external to the regenerator itself. The regenerator vessel, void of any of the above mentioned internals in the catalyst combustion zone, is refractory lined as are all connecting conduits, external cyclones and diplegs. The design of such a regenerator combination is considered to be a significant improvement over any known prior art. Regenerated catalyst at a desired elevated temperature is withdrawn from a relatively dense fluid catalyst bed in the second stage regenerator by means of a withdrawal conduit external to the regenerator vessel. The withdrawn catalyst is charged to a stripping zone before being passed to the riser reactor at the desired elevated vaporization temperature herein identified and in an amount sufficient to vaporize the residual hydrocarbon feed charged according to the operating techniques of this invention. Hot flue gases obtained from the second regenerator are fed to external cyclones for recovery of entrained catalyst fines before further utilization as by passing to a waste heat recovery system and then to an expander turbine or discharged to the atmosphere. Due to the fact that the cyclones of the highest temperature second regeneration stage are externally located some major and significant advantages aside from those cited above are gained. Once the cyclone separators are moved from the interior of the catalyst regeneration device to the exterior, it is practical to increase the diameter and/or length of the cyclone separation device and improve its separation efficiency in such a way that a single stage cyclone separator means can be used in place of a two stage cyclone separation means and yet accomplish improved separation efficiency. This is accomplished in part by use of a straight cylindrical pipe or obround flue gas transfer pipe or one including a curved section therein external to the cyclone and generally coinciding with the cyclone wall curvature and tangentially connected to the cyclone. This curved flue gas trasfer conduit means induces an initial centrifugal motion to the hot flue gas catalyst particle suspension thereby initiating entrained particle concentration and encouraging substantially improved cyclone separation efficiency between gases and solids thereby enabling significant changes in cyclone design. In addition, a most significant factor favoring the use of the external cyclone is that the cyclone overall length can be increased as it does not have to fit inside a refractory lined regenerator vessel of limited dimensions and space and the cyclone separating efficiency can be significantly improved. The net effect of the above flue gas transfer conduit and cyclone means is that a single stage external cyclone may be made the operating equivalent of a two-stage sequentially arranged internal cyclone separation system. Externally located refractory lined cyclones can be fabricated of carbon steel even when employed with a regenerator operated at a temperature above 1400° F. and up to 1800° F. Furthermore, the external cyclones can be checked during on stream use with an infrared camera and relatively easily repaired before being replaced during a shutdown or turn around.

The residual oil cracking process of this invention is considered a significant breakthrough over that more conventional FCC technology processing relatively clean gas oil feeds in that it allows one to more efficiently convert the high boiling residual components of the feed boiling above 1000° F. and more importantly permits providing the necessary and desired high catalyst temperatures while at the same time providing an operating environment not appreciably thermally harmful to the catalyst employed in the process than encountered in gas oil FCC operations. The desired ultimate high temperature catalyst regeneration operation of the invention is required to achieve the substantial instantaneous atomization/vaporization of the heavy residual oil feed components by the catalyst to substantially convert more of the bottom of a barrel of crude oil, shale oil, etc., or any other heavy high molecular weight liquid hydrocarbonaceous material to form lower boiling materials including gasoline. This is considered a major step forward in the petroleum refining industry and reduces the dependence of 'free world nations' on imported crude oil. It permits processing the poorer quality crude oils which are less expensive to obtain.

Additional benefits resulting from the resid cracking process of this invention are related to obtaining a reduction in energy consumption in the overall processing of the total crude oil barrel and permits achieving and a reduction in both air and water pollution. Some of these savings are achieved by shutting down vacuum distillation units, asphalt extraction units and various thermal processes such as delayed coking and thermal visbreaking in some instances. These and other known prior art processes would normally be used to further process atmospheric residua.

Typical energy savings in a crude unit operation by shutting down a vacuum unit is about 0.6 volume percent to 1.0 volume percent on crude charge. Also, air and water pollution frequently associated with the aforementioned deleted processes will be eliminated.

A further significant benefit of the residual oil cracking operation of the invention resides in obtaining a sulphur removal in the range of about 60–70% in the absence of substantial separate hydrogenation treatment. The $H_2S$ formed in the cracking operation may be removed by amine scrubbing from vaporous hydrocarbons and fed to a claus unit for elemental sulphur recovery and sales as such, as opposed to effecting substantial release as $SO_2$ in the regeneration combustion processes. It will be recognized by those skilled in the art that the conversion of residual hydrocarbons may be effected in a number of different apparatus arrangements perferably comprising a riser cracking zone provided with multiple hydrocarbon feed inlet means thereto for achieving intimate contact with fluidized catalyst particles and desired short contact time in a riser contact zone before discharging into a separation zone which may or may not contain a relatively shallow dense fluid catalyst bed. Separation of hydrocarbon products from catalyst discharged from the riser may be promoted by mechanical means or any arrangements identified in the prior art and suitable for the purpose. However, in any of these hydrocarbon conversion arrangements, regeneration of the catalyst used therein is most effectively accomplished when using the sequential regeneration techniques of this invention. Therefore, the regeneration concepts and operating techniques particularly contemplated and defined by this invention are used with considerable responsive advantage in any catalytic cracking operation.

BRIEF DESCRIPTION OF THE FIGURES

FIG. I is a diagrammatic sketch in elevation of a two-stage catalyst regeneration operation adjacent to and in combination with a riser hydrocarbon conversion operation. A catalyst recovery and collecting zone of restricted cylindrical dimension about the riser discharge encompasses preliminary catalyst-vapor separating means expanding outwardly in a horizontal direction from a riser reactor outlet and adjacent to cyclone separating means positioned in an upper portion of the collecting vessel.

FIG. II is a diagrammatic sketch in elevation of a side-by-side catalytic cracking-catalyst regeneration operation embodying a stacked arrangement of two-stage catalyst regeneration provided with relatively large cyclone separators positioned external to the vessel means for the second stage of high temperature catalyst regeneration.

FIG. III is a horizontal cross-sectional view of one arrangement of a rough cut separator means at the riser outlet of FIGS. I and II.

FIG. IV is a more detailed sketch of the lower portion of the riser hydrocarbon conversion zone of FIGS. I and II detailing particularly the multiple nozzle feed inlet means.

FIG. V is a graphical representation of the conversion achieved for two different systems of residual oil feed atomization. System two employed a more highly atomized feed than system one or the first system.

FIG. VI is a diagrammatic sketch in elevation of a bottom portion of a riser cracking zone, with regenerated catalyst inlet conduit, a fluidizing gas inlet conduit and a nozzle arrangement forming a highly atomized oil feed thereafter discharged within the riser at a relatively high velocity.

DISCUSSION OF SPECIFIC EMBODIMENTS

In the processing schemes discussed below, arrangements of apparatus are provided for accomplishing the relatively high temperature catalytic cracking of a residual oil to produce gasoline boiling range material and hydrocarbon materials readily converted into gasoline boiling components and fuel oils. Regeneration of the cracking catalyst so employed is accomplished particularly in a two-stage catalyst regeneration operation maintained under temperature restricted conditions in a first separate regeneration zone to particularly remove hydrogen deposited by hydrocarbonaceous products of the cracking operation. CO formation in the first regeneration zone is not particularly restricted and deactivation of the catalyst by steam formed in the hydrogen burning operation is held to a desired low level. Thereafter, hydrogen-free residual carbon is removed from the partially regenerated catalyst in a second separate relatively dense fluid catalyst system at a more elevated temperature and sufficiently high oxygen concentration restricting the formation of any significant quantity of CO or steam by effecting combustion of residual carbon deposits on the catalyst. The temperature of the second stage catalyst regeneration is allowed to rise sufficiently high to provide a desired oil contact temperature. Generally the temperature range of the regenerated catalyst will be from about 1400° F. up to 1800° F. The regeneration flue gas of the second stage regeneration operation will therefore be substantially CO free if not completely free of CO. Since the flue gas of the second stage regeneration operation will be $CO_2$ rich, such $CO_2$ rich gas may or may not be employed thereafter for steam generation, stripping catalyst between stages of the process and other uses for such gas as desired. The catalyst thus regenerated and comprising a residual carbon on catalyst of less than about 0.20 weight percent and preferably less than 0.05 weight percent is recycled to the cracking operation.

It will be recognized by those skilled in the art that the processing scheme of this invention minimizes high temperature steam deactivation of the catalyst and is an energy conserving arrangement which is particularly desired in this day of energy restrictions. That is, the two stage regeneration operation of this invention reduces the air blower requirement over that of a single stage regeneration operation while accomplishing more complete coke removal and heating of catalyst particles to a desired elevated temperature. The first stage restricted relatively low temperature regeneration operation is not restricted to CO formation wherein steam is usually formed and the second stage higher temperature regeneration operation is accomplished in the absence of formed steam wherein only a residual portion of the total carbon initially deposited on the catalyst is removed. These energy conserving operating conditions are of considerable economic advantage to the cracking operation in that a smaller CO boiler for producing process utilized steam can be used to process the volume of flue gas obtained from the first stage regeneration operation. The much higher temperature $CO_2$ flue gas recovered from the separated second stage regeneration and absent any significant combustion supporting level of CO may be cooled in a suitable device or heat exchange means generating additional steam.

The residual oil processing arrangement of the invention provides further significant energy conservation in that by charging an atmospheric residual oil feed portion of a crude oil to the cracking operation, energy intensive vacuum distillation, and deasphalting, delayed coking, and other forms of feed preparation requiring significant energy are eliminated. Steam generated by CO rich flue gas as above identified and/or process obtained normally gaseous hydrocarbons may be used with the feed as a diluent to improve atomization of the feed upon contact with the hot regenerated catalyst.

The hot catalyst particles obtained as herein provided and charged to the cracking operation can be at a desired high temperature than is normally obtained in the prior art single stage temperature limited regeneration operation. Furthermore it is obtained without effecting steam and/or hydro-thermal damage to the higher temperature catalyst. In addition the regeneration sequence of the invention more economically contributes more heat to the desired vaporization and endothermic catalytic conversion of the residual oil hydrocarbon charge as herein provided. Further energy conservation advantages are achieved by virtue of the fact that a residual oil comprising distress components of the crude oil boiling above 1025° F. are processed to more desirable lower boiling products including gasoline boiling range products and gasoline precursors through the elimination of satellite high energy consuming operations, such as vacuum distillation, propane deasphalting, visbreaking, delayed coking, feed hydrogen enriching operations and combinations thereof as employed heretofore in the petroleum refining industry.

The processing combinations of the present invention contemplate maintaining desired equilibrium catalyst in the system by replacing catalyst circulated in the system with catalyst particles of a lower metals loading obtained, for example, as fresh catalyst or as equilibrium catalyst from other clean feed cracking operations. Thus, a portion of the catalyst particles separated from the first stage low temperature regeneration operation or the second stage higher temperature regeneration operation or both as normal catalyst loss or by special withdrawal means may be replaced with fresh catalyst particles of suitable higher cracking activity and comprising lower levels of deposited metal contaminants.

The operating concepts of the present invention are useful in designing grass roots systems and adaptable to many different refining operations now in existence and comprising a single regeneration operation in combination with a hydrocarbon conversion operation such as a riser cracking or a dense fluid bed cracking operation. In any of these operations it is intended that the regeneration temperature necessarily be restricted to a low temperature first stage and a second higher temperature separate regeneration operation in order to achieve the advantages of the present invention particularly with respect to energy conservation and eliminating high temperature hydrothermal damage to the cracking catalyst in the presence of formed steam.

It is immediately clear that the sequential catalyst regenerating concepts of this invention permit improving substantially any hydrocarbon conversion process whether or not the hydrocarbon charged to the cracking operation comprises distress asphaltic components and metal contaminants or is merely a high coke producing charge material relatively free of significant amount of metal contaminants and/or asphaltenes. However, as provided herein, the advantages of the processing innovations of this invention substantially improve as satellite treatment of the crude hydrocarbon charge to remove these materials is reduced.

It will be further recognized by those skilled in the prior art, that existing temperature restricted catalytic cracking and regeneration apparatus may be modernized to achieve the higher temperature operations of this invention with a minimum capital expenditure and downtime whether or not one is modernizing a stacked single stage reactor regenerator arrangement, a side-by-side single stage reactor regenerator arrangement or one of the more modern units comprising a riser reactor hydrocarbon conversion zone in combination with a dense catalyst bed in open communication with an upper riser catalyst regeneration operation.

Referring now to FIG. I by way of example, spent catalyst particles recovered from a residual oil hydrocarbon conversion stripping operation and comprising hydrocarbonaceous deposits is passed by conduit 1 into a first dense fluid bed of catalyst 3 housed in regeneration vessel 5. Regeneration vessel 5 is identified herein as a relatively low temperature regeneration vessel wherein the temperature is maintained below about 1500° F. and the concentration of oxygen charged by regeneration gas in conduit 7 and distributor 9 is restricted to limit regeneration temperature encountered as desired during combustion or burning particularly of hydrogen and carbonaceous deposits associated with hydrocarbonaceous deposits of residual oil cracking. The combustion accomplished in the first stage regeneration operation herein identified is accomplished under conditions to form steam and a CO rich regeneration flue gas. The flue gas thus generated is passed through cyclone separators means represented by separators 11 and 13 to separate entrained catalyst particles therefrom before withdrawal by conduit 15. Catalyst thus separated from the CO rich flue gases by the cyclones is returned to the catalyst bed by appropriate diplegs. In regeneration vessel 5, it is particularly intended that regeneration conditions are selected so that the catalyst is only partially regenerated in the removal of carbonaceous deposits so that sufficient residual carbon remains on the catalyst to achieve higher catalyst particle temperatures above 1400° F. or above 1500° F. upon more complete removal by combustion with excess oxygen containing regeneration gas.

In the arrangement of FIG. I, the first stage of catalyst regenerations accomplished in vessel 5 is a relatively low temperature operation preferably restricted not to exceed about 1400° F. or 1500° F. and produce a CO rich product flue gas. Partially regenerated catalyst absent any significant amount of steam forming hydrogen is withdrawn from the catalyst bed of the first regeneration step by withdrawal conduit means 17 for passage to an adjacent stripping zone or vessel 19. A downflowing relatively dense fluid mass of partially regenerated catalyst is caused to flow through vessel 19 counter current to aerating and stripping gas introduced by conduit 21. The aerating gas is preferably one which will be relatively inert at least with respect to deactivating the partially regenerated catalyst and preferably is one which will considerably restrict the transfer of moisture formed components with the catalyst to a second stage of catalyst regeneration effected at a temperature above 1500° F. Aerating gases suitable for use in zone 19 include $CO_2$, flue gas substantially moisture-free, nitrogen, dry air and combinations thereof.

The partially regenerated catalyst is withdrawn from vessel 19 by a stand pipe 23 communicating with catalyst transfer conduit 25 and riser conduit 27. Gas such as air, nitrogen, $CO_2$ and mixtures thereof may be added to assist with transporting the catalyst by gas inlet conduits 29 and 31. A plurality of gas inlet conduits represented by conduit 29 may be employed in the conduit bend between conduits 23 and 25 and downstream thereof in the transport conduit to aid transport of catalyst therethrough. Regeneration gas such as air or an oxygen enriched gas steam is introduced by conduit 31 for contact with partially regenerated catalyst in riser conduit 27. Conduit 27 discharges into a bed of catalyst 33 maintained in the lower portion of a relatively large diameter regeneration zone or vessel 35. Additional regeneration gas such as air is introduced to a lower portion of catalyst bed 33 by conduit 37 communicating with air distributing means suitable for the high temperature operation to be encountered.

In the second stage regeneration operation effected in regenerator 35, the temperature is within the range of 1400° F. to 1800° F. and sufficiently higher than the first stage of regeneration to accomplish substantially complete removal of residual carbon not removed in the first stage. Regenerator vessel 35 is a refractory lined vessel substantially free of metal exposed internals and cyclones so that the high temperature regeneration desired may be effected. In this high temperature operation, residual carbon on catalyst is preferably reduced below 0.05 weight percent and a high temperature $CO_2$ flue gas stream is recovered by external cyclone separators. Preferably relatively large single stage cyclone separators are used which are refractory lined vessels. That is external plenum section 39 is provided with radiating arms from which cyclone separators are hung or arranged as graphically shown in the drawing by arms 41 and 43 and connected to cyclones 45 and 47 respectively. On the other hand, the cyclone arrangement of FIG. II discussed below may be employed with regenerator 35. Catalyst thus separated from flue gas at elevated temperatures up to 1800° F. is returned by diplegs provided. A high temperature $CO_2$ rich flue gas is recovered separately from each cyclone separator for further use as desired or as a combined hot flue gas stream 49 for generating steam in equipment not shown. It will be recognized by those skilled in the art that more than one cyclone separator may be used together in sequence and the number of cyclones in the sequence will be determined by the size of each and the arrangement employed.

The catalyst regenerated in the second stage of regeneration and heated to a temperature above the first stage regeneration temperature by burning residual carbon to a level below 0.10 weight percent and preferably below 0.05 weight percent carbon is withdrawn from bed 33 by conduit 51 and passed to an adjacent vessel 53. The withdrawn catalyst is aerated preferably by a moisture free gas introduced by conduit 55 or at least one substantially moisture free in the adjacent catalyst collecting zone or vessel 53. Aerating gas is withdrawn by conduit 57 and passed to the upper portion of vessel 35. Hot regenerated catalyst at a temperature above 1400° F. is withdrawn from zone 53 by a standpipe 59 comprising flow control valve 61. The hot catalyst then passes by transport conduit 63 to the lower bottom portion 65 of a riser hydrocarbon conversion zone 67. Aerating or lift gas, such as light hydrocarbons recovered from a downstream light ends recovery operation not shown or other suitable fluidizing gaseous material is charged beneath the catalyst inlet to the riser by conduit 60.

In the hydrocarbon conversion operation particularly contemplated, the hot catalyst of low residual carbon is caused to flow upwardly and become commingled with a multiplicity of hydrocarbon streams in the riser cross-section charged through a plurality of feed nozzles 71 arranged adjacent to but spaced inwardly from the riser refractory lined wall section. More particularly the riser wall is provided with an expanded wall section 73 through which the plurality of horizontally spaced apart feed nozzles pass upwardly and inwardly there through. A diluent gas such as steam, light hydrocarbons or a mixture thereof is added with the residual oil charged to enhance its atomized dispersion and vaporized commingling with the high temperature fluid catalyst particles. The riser section adjacent to the outlet of the feed injection nozzles is preferably expanded to a larger diameter riser vessel through which the suspension of vaporized oil and catalyst pass. To further assist with obtaining desired commingling and substantially instantaneous vaporization of the charged residual oil components, a number of small atomized oil feed streams are admixed with the charged upflowing catalyst. The vaporized hydrocarbon material comprising products of cracking admixed with suspended particles of catalyst pass upwardly through the riser 67 for discharge from the upper end of the riser through suspension separator means. Various means in the prior art may be used for this purpose. The initial suspension separator referred to as a rough cut separator at the end of the riser hydrocarbon conversion zone is shown as an outwardly expanding appendage from the riser resembling butterfly-shaped wing appendages in association with relatively large openings in the wall of the riser adjacent the capped upper end thereof. That is, the rough cut separator at the riser end viewed from the side and top resembles a butterfly-shaped device. The appendages are open in the bottom portion thereof to the surrounding vessel 87 for discharging hydrocarbon vapor separated substantially from catalyst particles. The sides 77, FIG. III, are solid substantially vertical panels and the ends 79 adjacent the wall of vessel 87 are solid substantially vertical curved panels. The top of each appendage is capped by a sloping roof 81 to minimize the hold-up of settled catalyst and coke particles thereon. The slope of the roof panel is preferably at least equal to the angle of repose of the catalyst employed and more preferably greater to avoid catalyst holdup on the appendage roof. Other arrangements known in the prior art permitting high vapor discharge velocities may be employed for effecting initial separation of the hudrocarbon vapor-catalyst suspension discharged from the riser upper end.

In operation, the vaporous materials comprising hydrocarbons and diluent in admixture with suspended catalyst is discharged through openings 75 in the riser and expanded within each appendage chambers A and B to reduce the velocity of the mixture, change the direction of the suspension components and concentrate catalyst particles separated from vaporous material along the outside vertical curved wall 79 of each appendage. The catalyst particles thus concentrated or separated, fall down the wall and are collected as an annular bed of catalyst 83 therebelow comprising a catalyst stripping zone. Vaporous materials separated from particles of catalyst pass downwardly through the open bottom of each appendage adjacent to riser wall and thence flow upwardly into one or more, such as, a plurality of cyclone separators represented by separator 85 in the upper portion of vessel 87. Hydrocarbon vapors, diluent and stripping gasiform material separated from catalyst is withdrawn by conduit 89 for passage to product recovery equipment not shown. Catalyst separated in the one or more cyclones is passed by diplegs provided to catalyst bed 83. Stripping gas such as steam, is charged to bed 83 by conduit 91. Stripped hydrocarbons pass with product hydrocarbon vapors leaving the rough cut separator and enter the cyclone separator arrangement. The stripped catalyst comprising hydrocarbonaceous product of residual oil cracking and metal contaminants is withdrawn by conduit 93 comprising valve 95 and thence is passed by conduit 1 to the first regeneration stage.

Referring now to FIG. II there is shown an arrangement of apparatus differing from the apparatus arrangement of FIG. I in that the separate regeneration vessels 2 and 4 are stacked one above the other on a common axis with the highest temperature regenerator 4 being the top vessel. In addition the hot flue gases are withdrawn from regenerator 4 through refractory lined piping 6 and 8 arranged to resemble a "T" with a large cyclone separator 10 in open communication with and hung from each horizontal arm 8 of the "T" pipe section. In this apparatus arrangement, the hydrocarbon conversion riser reactor 12 with multiple feed inlet represented by means 14 and suspension rough cut separating means 16 are shown the same as discussed with respect to FIG. I. However, it is contemplated using this system or other arrangements in combination with one, two, or more large cyclone separators 18 in an upper portion of the catalyst collecting vessel 20 adjacent the riser discharge within or external to the collecting vessel 20. An arrangement resembling that shown with respect to the upper regenerator 4 of the apparatus may also be employed.

In the apparatus arrangement of FIG. II, hot regenerated catalyst at a temperature above 1400° F. in conduit 22 and at least equal to the residual oil feed pseudo-critical temperature is charged to the base of riser 12 where it is commingled with lift or aerating gas introduced by conduit 24 to form an upflowing suspension. Catalyst thus aerated or suspended is thereafter caused to be contacted with a plurality of atomized oil feed streams by a plurality of feed nozzle means 14. In a particular embodiment there are 6 horizontally spaced apart nozzle FIG. IV extending through the riser wall adjacent an expanded section thereof in the manner shown. Steam or other diluent material may be injected with the feed for atomizing dispersion purposes as discussed above.

A vaporous hydrocarbon catalyst suspension passes upwardly through riser 12 for discharge through rough cut appendages 16 in a manner as discussed with respect to FIG. I. Hydrocarbon vapors separated from catalyst particles pass through one or more cyclone separators 18 for additional recovery of catalyst before passing the hydrocarbon containing vaporous material by conduit 26 to a product fractionation step not shown.

Catalyst separated by means 16 and cyclone 18 is collected as a bed of catalyst in a lower portion of vessel 20. Stripping gas, such as steam, is introduced to the lower bottom portion of the bed by conduit 28. Stripped catalyst is passed by conduit 30 with valve 72 to a bed of catalyst 32 being regenerated in vessel 2. Regeneration gas, such as air, is introduced to a bottom portion of bed 32 by conduit means 34 communicating with air distributor ring 36. Regeneration zone 2 is maintained as a relatively low temperature regeneration operation below 1500° F. and under conditions selected to achieve a partial removal of carbon deposits and all of the hydrogen associated with deposited hydrocarbonaceous material of cracking. In this operation a CO rich flue gas is formed which is separated from entrained catalyst fines by one or more cyclones, such as cyclones 38 and 40, in parallel or sequential arrangement with another cyclone. CO rich flue gases are recovered from the cyclone separating means by conduit 42 for use as herein discussed.

Partially regenerated catalyst is withdrawn from a lower portion of bed 32 for transfer upwardly through riser 44 for discharge into the lower portion of a dense fluid bed of catalyst 46 in an upper separate second stage of catalyst regeneration having an upper interface 48. Regeneration gas, such as air or oxygen enriched gas, is charged to the bottom inlet or riser 44 by a hollow stem plug valve 54 comprising flow control means 74. Additional regeneration gas, such as air or oxygen enriched gas, is charged to bed 46 by conduit 50 communicating with air distributor ring 52. Regeneration vessel 4 is a refractory lined vessel freed of metal appendages as discussed above so that the temperature therein is not restricted by metal appendages and may be allowed unrestrained to reach a higher temperature or exceed 1500° F. and go up to as high as 1800° F. or as required to complete carbon combustion. In this catalyst regeneration environment, residual carbon remaining on the catalyst following the first temperature restrained regeneration stage is substantially completely removed in the second unrestrained temperature regeneration stage. Thus the temperature in regenerator 4 is not particularly restricted to an upper level except as limited by the amount of carbon to be removed there within and sufficient oxygen is charged to produce a $CO_2$ rich flue gas absent combustion supporting amounts of CO by burning the residual carbon on the catalyst. The $CO_2$ rich flue gas thus generated passes with some entrained catalyst particles from the dense fluid catalyst bed 46 into a more dispersed catalyst phase thereabove from which the flue gas is withdrawn by conduits 6 and 8 communicating with more than one cyclone 10. Conduit means 8 is either straight or horizontally curved prior to tangential communication with cyclone 10. The curvature of conduit 8 is preferably commensurate in part with the curvature of the cyclone wall so that an initial centrifugal separation of entrained catalyst particles is effected in conduit 8 and prior to entering the cyclone separator. Catalyst particles are separated from the hot flue gases with a high degree of efficiency by this arrangement and the efficiency of the cyclone separating means can be more optimized by lengthening the conical bottom of the cyclone. Catalyst particles thus separated are passed by refractory lined leg means 56 to the bed of catalyst 46 in the high temperature regenerator. $CO_2$ rich flue gases absent combustion supporting amounts of CO are recovered by conduit 58 from cyclone 10 for use as herein described. Catalyst particles regenerated in zone or vessel 4 at a high temperature up to 1800° F. are withdrawn by refractory lined conduit 60 for passage to vessel 62 and thence by conduit 64 provided with valve 66 to conduit 22 communicating with the riser reactor 12 as above discussed. Aerating gas is introduced to a lower portion of vessel 62 by conduit means 68 communicating with a distributor ring within the vessel 62. Gaseous material withdrawn from the top of vessel 62 by conduit 70 passes into the upper dispersed catalyst phase of vessel 4.

The apparatus of FIG. II is a compact side-by-side system arranged in pressure balance to achieve desired circulation of catalyst particles and the processing conditions particularly desired as herein discussed. The operation of the system is enhanced by the use of spheroidal shaped particles of catalyst less than 200 microns and an average particle size may be selected from within the range of 50 microns up to 120 microns. It is contemplated modifying the system of FIG. II by providing external cyclones on vessel 20 with openings thereto about the upper end of the outlet of the riser conversion zone. The external zone separating means may also be arranged substantially similarly to that shown by conduits 6 and 8 and cyclone 10 of regenerator 4 and may be attached to a vertically shortened vessel 20 and used in place of internal cyclone 18. Catalyst particles thus separated would be conveyed by suitable diplegs communicating with the bed of collected particles in the lower portion of vessel 20 being contacted with stripping gas introduced by conduit 28.

Referring now to FIG. IV by way of example, there is shown in greater detail one arrangement of apparatus contemplated for separately charging hot regenerated catalyst and a residual oil feed to a lower portion of the hydrocarbon conversion riser zone 65 of FIG. I or riser 12 of FIG. II. The residual oil is fed through a plurality of tubes 71 which are either straight or curved. The tubes may be jacketed in a tube providing an annular zone for steam blanketing if desired. In the arrangement of FIG. IV, hot catalyst at an elevated temperature above identified and above the residual oil feed pseudo-critical temperature is charged by refractory lined conduit 63 to a bottom portion 65 of the riser hydrocarbon conversion conduit 67 each being lined with refractory material. Catalyst aerating or fluidizing gas is charged by conduit 69 to a gas distributor in the bottom portion of the riser. A hot suspension of catalyst and lift gas is formed in the bottom portion of the riser which thereafter passes upwardly through the riser into an expanded section thereof for contact with residual oil feed charged by plurality of feed inlet pipes 71. The oil feed charged by means 71 is mixed with a diluent such as steam or light hydrocarbons charged by conduit 109, thereby considerably reducing the partial pressure of the charged hydrocarbon feed. Jacket steam for the oil feed nozzle is charged to an annular section formed about pipe 71 by steam inlet means 111. A plurality of such jacketed nozzles horizontally displaced apart are provided which discharge in the cross-section of the riser and preferably there are six such nozzles positioned to achieve high temperature contact between fluidized catalyst particles and oil charged to achieve substantially instantaneous vaporization-atomization of the residual oil feed. The nozzle arrangement discharges into an expanded all section of the riser after passing through section 73 viewed in one arrangement as a half pipe section in the riser wall which is filled with refractory material. The nozzles are arranged to discharge in equal area diameter portion of the riser cross section so as to improve intimate atomization-vaporization contact with the upflowing suspended catalyst particles passing up the riser. The plurality of oil feed pipe outlets are preferably arranged in a circle and spaced from the riser wall within the expanded riser cross-section to achieved desired mixing of oil feed with the hot catalyst particles sufficient to achieve substantially instantaneous vaporization of the charged residual oil. It is recognized that various techniques known in the prior art comprising atomizing nozzles may also be employed to assure more complete and substantial atomization of the charged residual oil feed for more intimate vaporizing contact with the hot catalyst particles at a temperature of at least 1400° F. and within the range of 1500° F. to 1800° F.

The residual oil cracking operation of this invention relies upon the very high temperature catalyst regeneration operation for providing a catalyst of very low residual carbon at a temperature exceeding the pseudo-critical temperature of the residual oil feed charged in order to achieve substantially instantaneous vaporization of the charged oil feed. Another important aspect of the combination operation is to sustain catalyst activity by replacing some metals contaminated catalyst with fresher catalyst and effecting an initial regeneration of the catalyst under limited temperature conditions minimizing steam deactivation of catalyst particles during regeneration. The cracking operation of the invention is essentially a once through hydrocarbon feed operation in that there is no recycle of a cycle oil hydrocarbon product to the cracking operation. On the other hand, light normally gaseous hydrocarbon product, process generated steam and $CO_2$ may be recycled and used as above provided. It is further contemplated alkylating formed olefin components suitable for the purpose in downstream equipment not shown and hydrocracking formed hydrocarbon product material boiling above gasoline to produce additional gasoline and/or light oil product. The hydrocarbon product boiling above gasoline may be hydrogenated to remove sulphur and nitrogen to produce acceptable fuel oil material.

The catalytic cracking-catalyst regeneration concepts above discussed are addressed particularly to achieving a high degree of product selectivity in the catalytic conversion of high boiling hydrocarbons, particularly residual oils, in the production of cracked gasoline, gasoline precursors and catalytic cycle oils.

The processing concepts hereinafter discussed are more particularly directed to achieving a high degree of product selectivity in the cracking operations above discussed by paying more particular attention to another operating variable. This other operating variable is particularly concerned with achieving heavy oil feed atomization and the nozzle injection system more suitable for the intended purpose.

In this operating concept it is particularly desired to achieve at the point of contact of a highly atomized oil feed with fluidized catalyst particles substantially instantaneous vaporization-thermal and catalyst conversion of atomized oil droplets. The hydrocarbon vapor-catalyst suspension increases the velocity, thereof flowing upwardly through the riser and provides a dilute catalyst concentration in the suspension within the range of 1 to 10 pounds per cubic foot and more usually not above about 5 pounds per cubic foot. Thus the more rapid the instantaneous vaporization and conversion of the oil feed is achieved the less of a pressure drop is experienced adjacent to the atomized feed inlet and downstream contact with upflowing catalyst particles through the riser reactor.

It is observed when operating as herein disclosed that the product selectivity of the converted residual oil by thermal and catalytic means may be varied considerably depending upon the degree of heavy oil feed atomization brought in contact with the high temperature catalyst particles to achieve vaporization of the charged oil feed. One important operating variable is particularly concerned with utilization of a suitable atomizing nozzle feed inlet means providing a high degree of residual oil feed atomization and contact at a relatively high velocity with upflowing hot catalyst particles suitable for the purpose. Thermal and catalytic conversion of the vaporized oil feed to desired products is thus achieved in a very short time frame concomitantly with reducing the temperature of the formed suspension as herein discussed. In this preferred operating environment, a highly atomized oil feed is charged to the riser cracking zone at a velocity above 300 feet/second up to 1300 feet/second (fps) and dispersed in a fan-shaped pattern of about 10 or 15 degrees in a vertical direction by about 90 to 120 or more degrees in a generally horizontal direction to the riser cross-section. This helps to assure more intimate contact between an upflowing fluid suspension of finely divided hot catalyst particles of an initial particle concentration density in the range of from about 10 to about 35 lbs./cu. ft. This velocity of a formed suspension is substantially immediately velocity dissipated and forms an upflow hydrocarbon vapor dispersed catalyst particle phase suspension. The rapidity with which this is achieved minimized the pressure drop encountered in the formation of a relatively high velocity suspension of product vapors and catalyst discharged from the riser reactor at a velocity within the range of about 60 to about 120 ft./second. The catalyst concentration of the formed suspension may be varied considerably as required to optimize conversion of the hydrocarbon feed. The suspension catalyst concentration may be less than 5 pounds per cubic foot and may be as low as 1 or 2 pounds per cubic foot at the riser outlet.

When achieving substantially instantaneous vaporization of oil droplet, as herein discussed, thermal and catalytic conversion thereof is rapidly achieved in a short vertical space of the riser reactor in a time frame of very short duration. This may be associated with a small pressure drop in a vertical portion of the riser above the feed inlet up to about 5 feet but not more than about 10 feet thereof. The formed suspension temperature rapidly drops or is reduced to a level within the range of about 935° F. to about 1000° F. or 1050° F. as measured below or at the riser outlet. In conjunction with achieving instantaneous vaporization of the atomized oil feed, up to about 50% thermal conversion of the atomized oil feed occurs along with catalytic conversion thereof to form high yields of gasoline, gasoline precursors, and cycle oils. The cracking reaction combination is observed to occur in the riser in a very short time frame within the range of 0.5 seconds up to about 2.5 seconds and substantially complete desired conversion optimizing yields of gasoline product is believed to occur from about 0.5 seconds up to about 1 or 1.5 seconds. High yield of gasoline and light cycle oil products are obtained when achieving a low pressure drop within the riser reactor above the atomized feed inlet point and when restricting hydrocarbon vapors in the riser to less than 1.5 seconds in contact with suspended catalyst particles.

It is further observed in developing the residual oil conversion concepts herein expressed that atomizing the oil to a droplet size commensurate with or smaller than the used fluid catalyst particle size and comprising an average particle size selected from within the range of about 20 to about 150 microns also contributes to achieving rapid vaporization of the residual oil feed at relatively high velocity to form a low pressure drop suspension thereof in the riser reactor for flow there through as herein discussed.

In the graphical arrangement of FIG. V a comparison is made with respect to the conversion achieved between a first system of residual oil atomization and a second system. The second system comprises the feed nozzle arrangement of FIG. VI and achieves a much higher degree of feed atomization than achieved with a first system. FIG. V. is substantially self-explanatory and clearly shows a substantial improvement in catalytic conversion achieved between the first and second atomization system even though each experienced the same level of thermo conversion. In the first system of FIG. V comprising less than desired atomized residual oil feed conditions results in reduced catalytic conversion to desired gasoline product and thus less than desired product selectivity even though thermal conversion of at least about 50% is achieved. This observation is compared with a second residual oil feed atomizing nozzle system providing a more highly atomized oil feed commensurate in droplet size with the catalyst particle size. This assures a more complete vapor distributed residual oil feed for intimate instantaneous admixture with high temperature suspended catalyst particles sufficient to form a highly dispersed phase suspension therewith. It is graphically shown in FIG. V that each of these processing systems achieve similar thermal conversion but different total product selectivity. The second feed atomizing system of FIG. VI provides a higher overall conversion attributed to the improved atomized oil catalytic conversion operation. That is, when identifying catalyst activity on a basis of catalyst surface area times the catalyst to oil ratio, the second atomizing feed system of FIG. VI consistently provides higher levels of conversion with the more highly atomized feed as graphically shown. In this highly atomized and vaporized residual oil hydrocarbon conversion environment, it is preferred that the catalyst average surface area be retained at a level of at least 40 sq. m/g by continuous or intermittent replacement with higher surface area catalyst particles and preferably the catalyst surface area is retained at a higher level up to about 80 or 120 sq. m/g depending on hydrocarbon conversion desired and catalyst replacement economics.

The exact mechanism by which improved residual oil conversion, product selectivity and yield is achieved by system 2 over system 1 above identified is not completely identifiable except to note that the more highly atomized oil feed distributed generally horizontally across the riser cross-section by the nozzle means of FIG. VI apparently accomplishes very rapid vaporization of the fine oil droplets for intimate vaporized contact with the high temperature fluid catalyst particles at a temperature equal to or above the pseudo-critical temperature of the atomized residual oil feed.

It this appears that in the relatively severe residual oil-catalyst contact environment of system 2 that highly atomized oil droplets equal to or smaller than a catalyst average particles size of about 100 microns and uniformly dispersed therewith at the feed pseudo-critical temperature will be substantially completely vaporized in less than a fraction of a second if not thermally and catalytically substantially completely converted. It is apparent that such operating conditions comprising a highly atomized oil feed in contact with catalyst particles as above defined has a decidedly improved effect on the conversion and the selectivity of the product achieved.

In a catalytic cracking operation encompassing the operation herein identified, the phenomenon of accomplishing asphalt shattering to produce desired molecular reduction to at least tri-aromatics and lower forms is a new and novel operating concept over the prior art. This operating concept is particularly associated with obtaining high temperature thermal conversion or shattering of the asphalt component. This requires elevated catalyst temperatures above those normally employed and achievable by the regeneration technique above discussed to accomplish the desired asphalt molecular reduction.

In this novel residual oil catalytic cracking operation, it is considered critical to successful operation to obtain relatively instantaneous shattering of the asphalt components and its structures substantially at the point of feed injection in a very short time frame not more than a fraction of a second and in advance of or concommitantly with particularly promoting atomized gas oil component catalytic cracking. The shattering of the asphalt component of the feed will necessarily enrich the gas oil portion of the feed in aromatic constituents comprising di and tri-aromatics and larger ring compounds but preferably does not include any substantial or significant amounts of 4 and 5 ring aromatics.

The driving force for obtaining asphalt disintegration or molecular reduction is essentially thermal or temperature oriented and the impedance thereto is attributed to the heat transfer rate from high temperature catalyst particles to the asphalt molecule. The desired heat transfer rate increases exponentially as the particle or droplet size of the injected oil spray diminishes or decreases. Thus if super hot catalyst particles contacts super atomized oil, then the desired shattering of the asphalt molecule to mono, di and tri-aromatics is accomplished with high efficiency, without condensation of polyaromatic rings as observed in coking processes leading to higher coke production. In this asphalt shattering environment, the accomplishing time frame must be of sufficient short duration so that the cracking catalyst structure is not unduly masked by coke levels so high that normal conversion of the lighter gas oil component of the feed is discouraged or unduly restricted. Thus a major role of the catalyst to oil ratio beyond asphalt shattering is to support a mix temperature sufficiently high or elevated to provide normal endothermic catalytic conversion of the 1000° F. minus crackable portion of the gas oil components of the residual oil feed. In this regard, it will be recognized that a small catalyst circulation rate of extremely hot catalyst or low temperature catalyst particles will not achieve this desired conversion goal as effectively as a larger circulation rate of sufficiently elevated temperature catalyst particles providing a desired high catalyst to oil ratio.

It is observed that there is a catalyst temperature most suitable and desirable for effecting desired conversion of a given asphalt content residual oil feed-stock. This is referred to and is identifiable with the residual oil pseudo-critical temperature. Furthermore, the conversion temperature must be increased as the percentage of asphalt in the feed increases to achieve desired rapid or instantaneous vaporization of the heavy oil feed in the presence of hot catalyst particles in order to achieve desirable product selectivity and low coke yields. In this regard, the desired catalyst temperature occurs almost automatically in the special two-stage regeneration operation above defined as the asphalt content of the feed increases and when the second stage catalyst regenerator temperature is not restrained in the burning or combustion of carbon deposits. This is because the coke level on the spent catalyst increases with a higher asphalt content feed.

This higher coke level catalyst charged to catalyst regeneration will cause the regenerated catalyst temperature to rise to higher levels. Regeneration of catalyst particles of higher than normal coke levels is a matter of concern in protecting catalyst activity.

The processing combination herein identified relies upon high temperature rapid shattering of the asphaltic component in a highly atomized residual oil feed as discussed above along with recovery and disposal contributing to improve yields of gasoline and light cycle oil. The shattering of particularly the asphalt component of the residual oil feed is of such a nature as to provide significant amounts of di and tri-aromatics along with some higher boiling multi-cyclic compounds. These components which generally resist conversion by catalytic cracking respond to hydrocracking in the form of hydrogenated product of lower ring configuration favoring mono and di-cyclic rings contributing to gasoline and/or low, poor, high cetane distillate material formation. In addition, the hydrogenated higher boiling product material of hydrocracking is a hydrogen donor material for the residual oil feed upon recycle to the catalytic cracking operation.

The residual oil catalytic cracking-catalyst regeneration process herein identified is a substantial breakthrough in catalytic cracking technology that economically removes metallurgical restraints on regenerator equipment and temperatures achieved. It accomplishes asphalt molecular reduction contributing to further improved gasoline yields and light fuel oil yields particularly when synergistically related to hydrogenation operations including hydrocracking of multicyclic components in the cycle oil product of the catalytic cracking step. The process combination herein described is responsive and adaptive to changes in feed stock properties. In yet another important aspect is the finding that no unusually elaborate instrumentation or control systems is required to maintain smooth and stable operation.

The rapidity with which a residual oil is converted to form gasoline, lower and higher boiling hydrocarbons by high temperature catalyst as above expressed is further enhanced when more emphasis is placed on the following operating parameters. That is, for example, when the riser cracking system of FIG. II above described is modified to include the feed nozzle arrangement of FIG. VI for preparing and charging highly atomized residual oil feed droplets in fan-shaped contact at high velocity with upflowing high temperature fluid catalyst particles suspension in the riser, significantly improved conversion result. In this operation it is desirable that the rising catalyst suspension be of a concentration in the range of at least 10 up to about 35 or more pounds of catalyst particles per cubic foot to assure rapid and intimate contact with the charged highly atomized oil feed herein identified.

The improved residual oil riser conversion operation of this invention relies in substantial measure upon charging a highly atomized residual oil feed herein identified at a relatively high velocity in contact with catalyst particles of an average particle size in the range of about 20 to 150 or less microns such as not more than about 120 microns and comprising a surface area in the range of 40 to 120 sq. m/g. Catalyst particles of an average particle size selected from within the range of about 60 to about 120 microns are particularly contemplated. The atomized oil feed droplet may be equal to or less than the catalyst average particle size. However, it is preferred that the atomization of the oil feed be of a droplet size commensurate with the catalyst particle size distribution or smaller than the average particle size.

A most significant aspect of a successful residual oil riser cracking operation is associated with achieving rapid thermal cracking of particularly asphaltenes, catalytic cracking of crackable vaporous components and rapidly achieving a suspension temperature reduction which will substantially minimize thermal product degradation in the form of high coke yields. In pursuit of more particularly identifying the improved residual oil riser conversion operation of this invention the following was developed.

TABLE 1

Vaporization Time for Atomized Reduced Crude Oil

| Droplet Size (Microns) | Vaporization Time (Milliseconds) |
|---|---|
| 300 | 85 |
| 200 | 40 |
| 100 | 9 |
| 50 | 3 |
| 20 | 2 |
| 10 | 1 |

It is clear from Table 1 that a reduced crude or residual oil atomized to a droplet size of 100 microns or smaller as herein particularly desired requires a very short vaporization time equal to or less than 9 milliseconds when contacting catalyst particles at a temperature at least equal to the pseudo-critical temperature of the oil feed.

The catalyst regeneration-riser cracking concepts for processing residual oil and reduced crudes as herein identified are concerned with obtaining a high degree of desired product selectivity at the expense of producing coke and less desired gaseous material.

It is clear from the discussion above presented that at the instant of atomized feed injection and contact with a suspension of high temperature catalyst particles as herein identified, all consequential reactions and interactions occur in a very short time frame over the range of milliseconds up to about 1 second but less than about 2 seconds depending on the operating parameters of temperature, feed atomization, catalyst activity expressed in terms of surface area and contact time. Furthermore, these conditions all pass through a transition during traverse of the riser reactor in a manner contributing to the ultimate products desired and comprising gasoline, cycle oil and an amount of coke consistent with providing a heat balanced operation. One particular important aspect to be avoided appears to be associated with prolonged contact of products of cracking comprising di and tri-cyclic aromatic type material to high temperature catalyst since this tends to contribute to product degradation and coke formation. Therefore, a very rapid temperature reduction following vaporization and cracking of the feed not to exceed about 2 seconds and preferably less than about 1 second appears important to optimize the yield of gasoline and cycle oil products. This is particularly achieved by following the improved riser operating concepts above expressed. A rapid temperature reduction to within the range of 950 to about 1050 is desired.

The preferred operating concepts above expressed are accompanied by a rapid molar expansion of vaporous products of cracking at the elevated temperature initially employed which inherently contributes to achieving a substantial increase in the formed suspension velocity concurrently with catalyst particle acceleration in a fraction of a second. A residual oil cracking operation accomplished within the operating concepts identified, minimizes radial maldistribution of the suspension in the riser and thus catalyst agglomeration and other localized catalyst particle concentrations along the riser wall contributing to undesired high catalyst to oil ratio are avoided.

The rapid residual oil feed vaporization and conversion thereof under relatively high velocity conditions as herein identified is found associated with a very low pressure drop operation within the riser in a limited vertical space above the feed nozzle inlet less than about ten feet. This low pressure drop condition is found to be the opposite of that experienced and identified with poor oil feed catalyst mixing in initial portions of a riser up to 5 to 10 feet thereof. Thus it is clear that a high degree of oil feed atomization is an essential operating parameter and its distribution across the riser cross-section in a pattern which promotes intimate instantaneous vaporization contact with catalyst particles for conversion thereof as herein identified. A fan-shaped pattern of 10 or 15 degrees in a vertical direction by about 80 to 150 degrees in a direction perpendicular thereto is found to provide a high degree of intimacy of contact. The discharge of atomized oil feed at high velocity of about 500 ft./second more or less as herein contemplated is not found to be detrimental to the process. That is, it has been determined that employing an atomized oil discharge velocity at the nozzle outlet of 1300 ft./second is rapidly dissipated at a distance therefrom of one inch to about 650 ft./second and to only 350 ft./second at a distance of 2 inches from the nozzle tip. At six inches the velocity is reduced to 130 ft./second. The processing concepts of this invention for effecting riser cracking of a residual oil feed is accomplished in a very short time frame of about 2.5 or not more than about 1.5 seconds depending on the residual oil feed charged and the temperature provided by the catalyst when employing feed preheat below 800° F. and more usually not above about 500° or 600° F.

In the arrangement of FIG. VI, the riser bottom section 82 is of smaller diameter than an upper portion thereof and are connected by a transition section 84. Fluid catalyst particles are charged to the lower bottom smaller diameter portion of the riser by conduit 86. Fluidizing gas is charged to the riser beneath the catalyst inlet conduit 86 by conduit 88 communicating with a distributing ring within the riser cross-section. Conduit 90 provided with valve 92 permits withdrawing catalyst from the bottom of the riser. The fluidized gas charged by conduit 88 may be gaseous products of catalytic cracking from which gasoline precursors are separated or steam may be employed. A fluidizing gaseform material such as low quality naphtha may be used alone or in admixture with recycled product hydrocarbon gases as a transition fluidizing medium for effecting smooth directional change in fluid upflow of hot catalyst particles as as a suspension upwardly in a bottom portion of the riser up to the feed nozzle outlet in the expanded riser section. Instrument taps may be provided in the riser wall and particularly above transition section 84 for determining pressure drop and temperature of the operating system.

The feed injection nozzle comprises a barrel 94 with a restricted slotted end opening 96 housed in a cylindrical heat dissipating shroud 98. The nozzle passes through the riser wall adjacent to but above the riser transition section at an upwardly slanted desired angle. An angle of about 30 degrees in this specific embodiment is found satisfactory. The oil feed is charged to the atomizing section of the nozzle with or without a diluent gaseform material such as steam, light hydrocarbons or other suitable material to reduce the partial pressure and/or viscosity of the oil charged by conduit 100 in communication with orifice opening 102 so that the orifice discharged heavy oil will impinge upon a flat surface 104 to form droplets thereof which are further sheared to a finer droplet size by a high velocity gaseous material charged by conduit 106 communicating with orifice restriction 108. The atomized heavy oil feed of desired droplet size commensurate with the fluid catalyst particle size as above identified and formed exterior to the riser reactor passes through a barrel portion of the nozzle system at high velocity for discharge from the end thereof by a slotted opening 96. A single restricted slot opening may be relied upon for producing a fan-shaped pattern of atomized oil droplets in the riser cross-section. There may be two slots, for example, in parallel arrangement of 90 degrees to one another. It is preferred that two or more of such nozzle system arrangements be provided and equally spaced apart horizontally around the riser periphery from one another. For example, there may be 3, 4 or more of such nozzle systems. It is also contemplated vertically staggering 2 or more of the nozzle arrangements discussed in a restricted vertical space of the riser reactor above the transition section to provide a highly turbulent intimate contact section of highly atomized oil feed in contact with upflowing particles of catalyst of desired elevated temperature at least equal to the oil feed pseudo-critical temperature.

It is contemplated providing the oil feed nozzle arrangement discussed in an upper portion of the riser reactor wall not more than about ten feet below the riser outlet so that the product vapor of thermal and catalytic cracking can be rapidly separated from catalyst upon discharge from the riser upper outlet.

Having thus generally discussed the many operating concepts contributing to the novel combination operation of the invention for upgrading heavy oil streams such as residual oil streams, reduced crudes, tapped crude and the like and described specific examples pertaining thereto, it is to be understood that no undue restrictions are to be imposed by reasons thereof except as defined by the following claims.

What is claimed is:

1. A method for converting a residual portion of crude oil with high temperature fluid catalyst particles which comprises, (a) flowing a suspension of high temperature fluid catalyst particles upwardly through a riser conversion zone, (b) atomizing a residual oil feed to be converted to a droplet size commensurate with or smaller than the high temperature suspended catalyst particles of a size in the range of 20 to 200 microns, (c) charging the atomized residual oil of (b) at a velocity in the range of 300 to 1300 ft./sec. into contact with said upwardly flowing hot catalyst particle suspension initially at a temperature at least equal to or above the residual oil feed pseudo critical temperature, (d) the temperature of contact between said catalyst particles and said atomized residual oil feed initially sufficiently elevated to shatter asphalt component in said residual oil and obtain up to 50 percent thermal conversion of the atomized oil feed, effecting catalytic conversion of oil vapors formed in said upflowing suspension thereby reducing the temperature of the suspension, and (e) separating vaporous hydrocarbon conversion products of step (d) from catalyst particles following traverse of said riser zone in a time frame less than about 2 seconds.

2. The method of claim 1 wherein the discharge velocity of the atomized oil feed into the catalyst suspension is about 500 ft./sec.

3. The method of claim 1 wherein the velocity of contact between the charged atomized oil feed and the catalyst suspension restricts the pressure drop in the riser not to exceed about 3 psig.

4. The method of claim 1 wherein the pressure drop about 10 feet downstream from the atomized oil feed inlet is not more than about 1 psig.

5. The method of claim 1 wherein the atomized residual oil feed is charged to the riser conversion zone as a plurality of separate fan-shaped droplet dispersions across the riser zone for intimate contact with upflowing fluid particles of catalyst at a temperature sufficiently elevated above the oil feed pseudo-critical temperature to thermally crack asphaltenes in the oil feed.

6. The method of claim 1 wherein the catalyst average particles size is within the range of 20 to 120 microns and the residual oil is atomized to droplets equal to or less than 100 microns.

7. The method of claim 1 wherein atomization of the oil feed is accomplished external to the riser cracking zone and formed atomized oil droplets are thereafter conveyed through an elongated confined zone communicating with a narrow elongated opening in the cross sectional end thereof positioned horizontally to the riser cross-section.

8. The method of claim 7 wherein the atomized oil feed is discharged from said elongated opening at a velocity above 300 ft./sec. in a horizontal fan-shaped droplet pattern inclined generally upward in said riser.

9. The method of claim 1 wherein thermal and catalytic conversion of the atomized residual oil feed with the suspended catalyst is accomplished in the riser in a time frame within the range of 0.5 up to 1.5 seconds.

10. The method of claim 1 wherein the catalyst separated from hydrocarbon products and comprising hydrocarbonaceous deposits are passed through two sequential stages of catalyst regeneration, the first stage being sufficiently combustion temperature restricted to produce a CO rich flue gas whereby hydrothermal degradation of the catalyst in the presence of formed steam is minimized, and the second stage of catalyst regeneration is combustion promoted sufficient to produce high temperature $CO_2$ rich flue gases comprising oxygen whereby substantially complete removal of carbon on the catalyst is achieved to produce catalyst particles at a temperature at least equal to or above the residual oil feed pseudo-critical temperature.

11. The method of claim 1 wherein the catalyst particles provide a surface area within the range of 40 to 100 sq. m/g and temperature conditions sufficient to provide a conversion of the oil feed consistent with the upper curve of FIG. V.

12. The method of claim 1 wherein atomization of the residual oil feed to form small droplets less than 100 microns and the temperature of the atomized oil catalyst suspension is sufficient to achieve thermal disintegration in a fraction of a second of feed component boiling above 1025 F. comprising asphalt and asphaltenes to form mono, di and tri aromatic components in the hydrocarbon product.

13. The method of claim 1 wherein thermal and catalytic conversion of the highly atomized residual oil feed with the catalyst suspension reduces the temperature of the formed vapor catalyst suspension in the riser to within the range of about 935° F. to about 1050° F.

14. The method of claim 1 wherein the conversion temperature is increased as the asphalt content of the residual oil feed is increased and regeneration of the catalyst is completed at a temperature satisfying the higher asphalt content residual oil feed pseudo-critical conversion temperature.

* * * * *